US006013215A

United States Patent [19]

Iwamoto et al.

[11] Patent Number: 6,013,215

[45] Date of Patent: Jan. 11, 2000

[54] METHOD OF MANUFACTURING AN INORGANIC MOLDED PRODUCT

[75] Inventors: Yoshimi Iwamoto; Kiyohisa Kitagawa; Kazuhiro Kurihara; Masahiro Hirao, all of Tokyo, Japan

[73] Assignee: Mitsui Wood Systems, Inc., Japan

[21] Appl. No.: 09/037,795

[22] Filed: Mar. 10, 1998

[51] Int. Cl.[7] ..... B28B 1/26

[52] U.S. Cl. ..... 264/87; 249/141; 425/85; 425/405.1

[58] Field of Search ..... 264/86, 87; 425/84, 425/85, 405.1; 249/141

[56] References Cited

U.S. PATENT DOCUMENTS

| | | |
|---|---|---|
| 1,271,296 | 7/1918 | Everett . |
| 2,671,940 | 3/1954 | Billner . |
| 3,099,061 | 7/1963 | Marchioli et al. . |
| 3,284,284 | 11/1966 | Wells . |
| 3,655,847 | 4/1972 | Morgan . |
| 3,832,108 | 8/1974 | Posch et al. . |
| 3,838,001 | 9/1974 | Greiner et al. . |
| 3,980,414 | 9/1976 | Shannon et al. . |
| 4,079,108 | 3/1978 | Farfor . |
| 4,335,065 | 6/1982 | Ando . |
| 5,603,808 | 2/1997 | Nishikawa . |

*Primary Examiner*—Karen Aftergut
*Attorney, Agent, or Firm*—Wenderoth, Lind & Ponack, L.L.P.

[57] ABSTRACT

A method of compression-molding a slurry of a hydraulic inorganic material such as cement or slag, a light-weight aggregate, a reinforced fiber material and other filler material kneaded with water so as to manufacture an inorganic molded product. The slurry is put into a molding frame having a filtering cloth placed over the bottom surface thereof and is then compression-molded in the molding frame by using a molding die while it is suction-dehydrated from on both sides of the molding die surface and the filtering cloth surface. The molding die has a number of vent holes for sucking-dehydration each of which vent holes comprises a small-diameter hole and a large-diameter hole continuous therewith.

4 Claims, 2 Drawing Sheets

METHOD OF MANUFACTURING AN INORGANIC MOLDED PRODUCT

TECHNICAL FIELD

The present invention relates to a method of manufacturing an inorganic molded body or product to be used as a building or construction plate material or the like.

BACKGROUND OF THE INVENTION

When an inorganic molded product such as a flat plate, a convex-concave pattern plate is formed with a slurry obtained by kneading a hydraulic inorganic material such as cement or slag, a light-weight aggregate, a reinforced fiber material and other filler material with water, there is a problem that the dehydration molding of the slurry is not easy due to the highness of the density of the solid component of the slurry and the poor freeness of the slurry. Therefore, it is generally known to use a lamination sheet molding method in which several thin sheet materials such as calcium silicate plates, asbestos cement plates produced by a paper making method are laid one above another and dehydration-molded, or a single layer sheet molding method in which the above-mentioned slurry is poured into a molding frame and is dehydrated by compression for a long time using a molding die while vibrating, or without vibrating, the molding frame, to thereby obtain the above-mentioned molded body.

However, these conventional methods have had the disadvantage that the molding operation is complicated and it takes a considerably long time to complete the molding operation because it requires a long time for dehydrating the slurry at the time of molding and especially they have had the problem that when an industrial large scale production is performed, the productivity thereof is not favorable and the manufacturing cost increases. Further, when it is necessary to form a convex-concave pattern on the molded surface as in the case of molding the above-mentioned convex-concave pattern plate, the depth of the convex-concave portion has hitherto been within the limits of less than 5 mm to the utmost and it has been difficult to form an outstanding deep drawing beyond the above-mentioned limits. Accordingly, it has been difficult to manufacture the above-mentioned molded product of a clear and beautiful pattern from a design point of view.

DISCLOSURE OF THE INVENTION

The present invention has been made in view of the above-described problems and an object of the invention is to eliminate the disadvantages of the conventional molding methods and to provide an improved method of manufacturing an inorganic molded product.

In the method of manufacturing an inorganic molded product according to the present invention, a slurry obtained by kneading a mixture of a hydraulic inorganic material such as cement or slag, a light-weight aggregate, a reinforced fiber material and other filler material with water is poured into a molding frame having a filtering cloth disposed on the bottom surface thereof and is compression-molded by a molding die attached to an upper platen of the press and the purport of the invention resides in that the slurry is compression-molded while it is dehydrated by sucking from on both sides of the molding die surface and the filtering cloth surface and the molding die is provided with a number of vent holes for dehydration by sucking with each of the holes comprising a small-diameter hole and a large-diameter hole continuous therewith on the side of the molding die surface.

Further, the above-described sucking-dehydrating pressure on the side of the molding die surface and that on the side of the above-described filtering cloth are preferably in the range of 500–760 mmHg, and if the pressures are below 500 mm Hg, they are insufficient for smooth dehydration of the slurry.

Moreover, when an inorganic molded body is released from the molding die after compression-molding it, it is preferable to release the inorganic molded body by reducing the sucking-dehydrating pressure on the side of the molding die surface to 100–400 mmHg while keeping the like pressure on the side of the filtering cloth surface at 500–760 mmHg and with these pressure values, it is possible to prevent the water sucked by the molding die surface from returning to the molded body and at the same time, to release the molding die with ease.

As described above, it has been found that by the dehydration by sucking of the slurry from on both sides of the molding die surface and the filtering cloth surface, it is possible to smoothly dehydrate the slurry at the time of compression molding to thereby save time and by forming on the molding die surface a number of vent holes each comprising a small-diameter hole and a large-diameter hole continuous therewith for dehydration by sucking, the vent holes do not become clogged.

BEST MODE FOR CARRYING OUT THE INVENTION

A preferred embodiment of the present invention will now be described with reference to the accompanying drawings.

Figure 1:
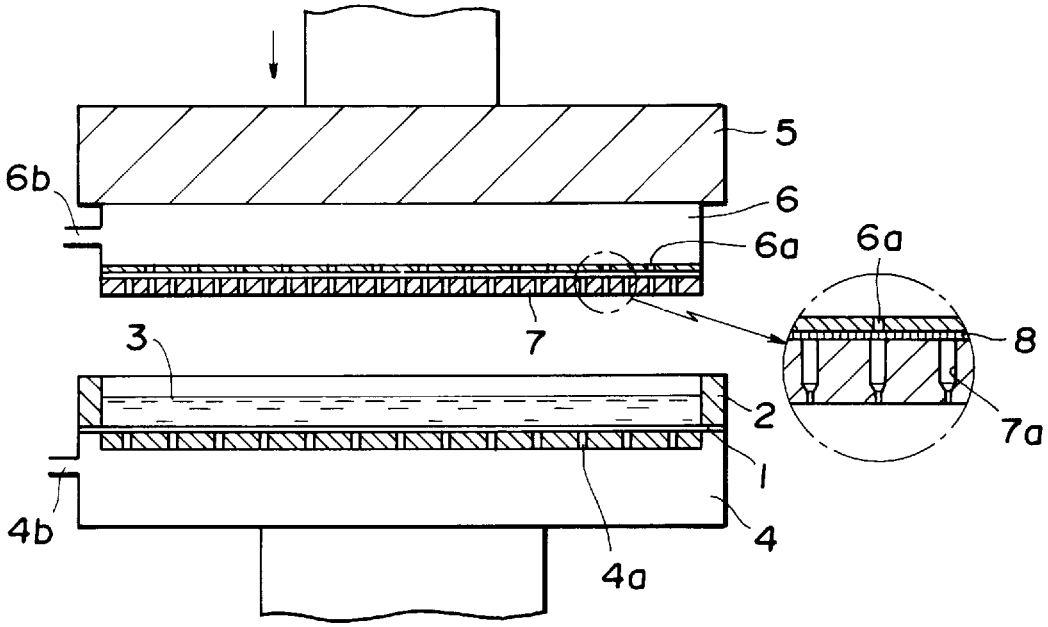
FIGS. 1, 2 and 3 are illustrations of a method of manufacture of inorganic molded body according to a preferred embodiment of the present invention.

In these figures, a mixture of 60 parts by weight of a hydraulic inorganic material consisting of a mixture of cement and slag in a proper ratio, 10 parts by weight of a light-weight aggregate, 10 parts by weight of a reinforced fibrous material, 20 parts by weight of other filler material and 240 parts by weight of water was kneaded to produce a slurry 3. Then, as shown in FIG. 1, 7 kg of the slurry 3 was poured into a molding frame 2 (a mat making box) of 36 cm (width)×50 cm (length) and a depth (75 mm) having its bottom surface placed with a filtering cloth 1 made of a wire netting or a plastic material and the surface of the slurry was smoothed flat. In the drawing, reference numeral 4 designates a metallic suction box provided with a number of through-holes 4*a* in the surface thereof. In this embodiment, it serves as a lower platen of the press.

Further, a molding die 7 screw-fixed to a suction box 6 which is screw-fixed to the upper platen 5 of the press is caused to lie above the slurry 3. The suction box 6 is provided with a number of through-holes 6*a* in the lower surface thereof and between the suction box 6 and the molding die 7 there is disposed a filtering cloth 8 similar to the above-mentioned filtering cloth 1. Next, the molding die 7 was moved downward as indicated by the arrow together with the suction box 6 and the upper platen 5 of the press.

The molding die 7 is made of a metallic or plastic flat plate of a thickness of 30 mm having a pressure-resistant strength and provided with a number of vent holes 7*a* for the below-mentioned suction dehydration each comprising a small-diameter hole on the side of the molding die surface and a large-diameter hole continuous therewith. The inner diameter and the length of each of the small-diameter holes and those of each of the large-diameter holes or the space between the vent holes may be determined properly depending on the practical mode of carrying out the invention but in the instant embodiment, the diameter of the small-diameter hole is 0.7 mm and the length thereof is 2 mm, diameter of the large-diameter hole is 3 mm and further, the space between the adjacent vent holes is 20 mm.

Figure 2:
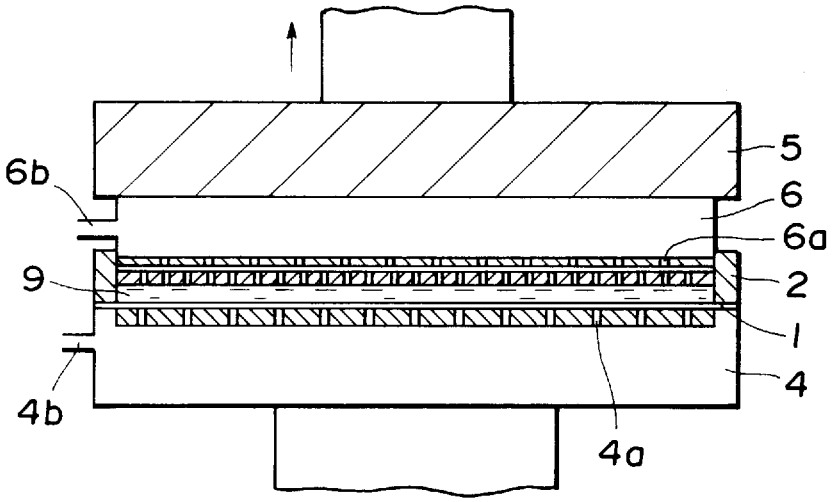
Figure 3:
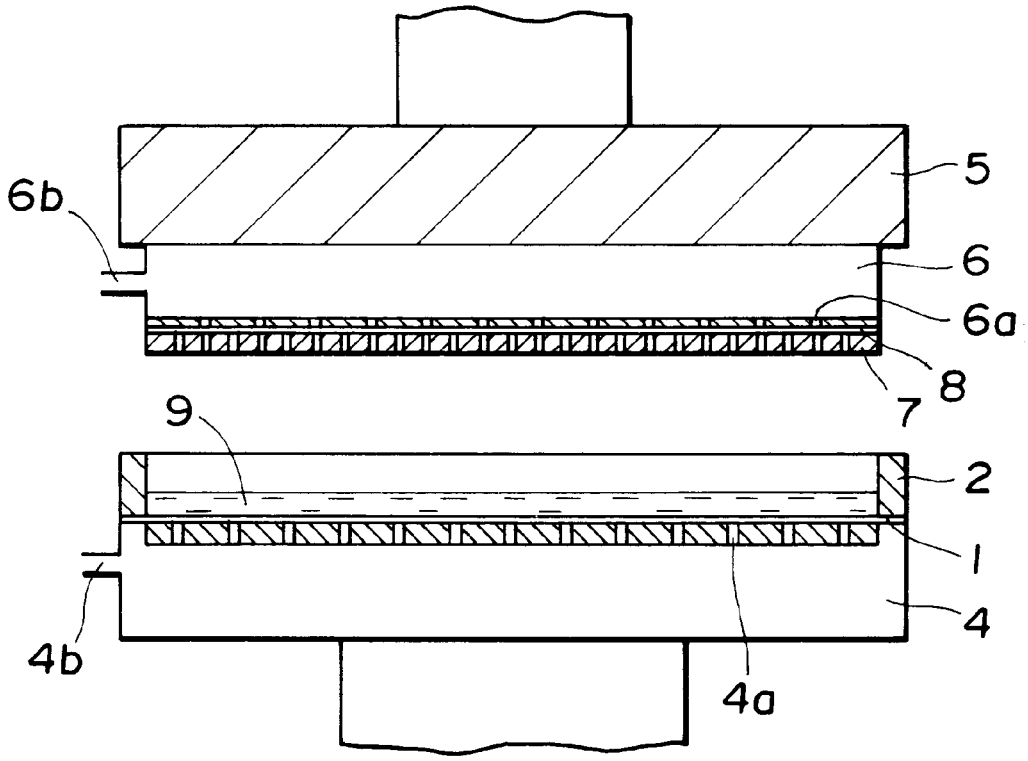

Further, in the state shown in FIG. 2, the slurry 3 is dehydrated by the suction boxes 4 and 6 from on both the upper and the lower surface of the slurry through the suction ports 6*b* and 4*b*, respectively, under a sucking pressure of 600 mmHg while the slurry is applied with a pressure of 15 $kg/cm^2$ for five seconds to thereby become compression-molded, then the sucking pressure from on the side of the upper surface of the slurry is reduced to 300 mmHg, the molding die 7 was moved upward as designated by the arrow together with the suction box 6 and the upper platen 5 of the press so as to leave a molded mat 9 from the molding die 7 as shown in FIG. 3 while the sucking pressure from the lower surface of the slurry was kept at 600 mmHg. The molded mat 9 thus obtained had a flat plate-like beautiful molded surface. After releasing, the molded mat 9 was taken out and then cured and dried to thereby obtain a flat plate-like inorganic molded product of a thickness of 12 mm.

The above process is an example of manufacturing a flat plate-like inorganic molded body but when an inorganic molded body having a convex-concave pattern on the molded surface thereof is produced, it goes without saying that a molding die having a pattern corresponding to the convex-concave pattern and provided with a number of vent holes each comprising a small-diameter hole and a large-diameter hole may be used to produce the molded body according to the same process as described above.

As described above, the manufacturing method of the present invention has the effect of saving time at the time of compression molding without impairing the moldability so that a great industrial availability of the invention can be obtained.

What is claimed is:

1. A method of manufacturing an inorganic molded product in which a slurry obtained by kneading a mixture a hydraulic inorganic material, a lightweight aggregate and a reinforced fiber material with water is poured into a molding frame having a filtering cloth placed on a bottom surface thereof and compression-molded by a molding die attached to an upper platen of a press, wherein said slurry is compression-molded while it is dehydrated by sucking from both sides of a molding surface of said molding die and a surface of said filtering cloth, and said molding die comprises, on said molding surface thereof, no filtering cloth and a number of vent holes each having a large-diameter hole portion followed by a small-diameter hole portion continuous with said large-diameter hole portion, so as to dehydrate said slurry by sucking through said vent holes.

2. The method according to claim 1, wherein sucking-dehydrating pressures on said side of said molding die surface and that on said side of said filtering cloth surface are in a range of between 500 and 760 mmHg.

3. The method according to claim 1, wherein a sucking-dehydrating pressure on said side of said molding die surface is reduced to a range of 100–400 mmHg after compression molding, and an inorganic molded mat is released from said molding die while keeping a sucking-dehydrating pressure on said side of said filtering cloth surface at 500–760 mmHg, which inorganic molded mat is then cured and dried to thereby obtain said inorganic molded product.

4. The method according to claim 1, wherein said molding die comprises a flat plate or a convex, concave pattern on said molding surface thereof.

* * * * *